United States Patent [19]

Fleenor et al.

[11] Patent Number: 4,925,187

[45] Date of Patent: May 15, 1990

[54] BOWLING HAND AND WRIST SUPPORT DEVICE

[76] Inventors: Charles R. Fleenor; Shirley A. Fleenor, both of 1015 Hickory Hill Dr., Columbia, Mo. 65203

[21] Appl. No.: 295,377

[22] Filed: Jan. 10, 1989

Related U.S. Application Data

[62] Division of Ser. No. 5,692, Jan. 22, 1987, Pat. No. 4,846,473.

[51] Int. Cl.[5] ..... A63B 71/02

[52] U.S. Cl. ..... 273/54 B; 128/90

[58] Field of Search ..... 273/54 B, 189 A; 128/89 R, 90; 2/161 A

[56] References Cited

U.S. PATENT DOCUMENTS

| | | | |
|---|---|---|---|
| D. 225,389 | 12/1972 | Carter | 273/54 B X |
| 3,423,095 | 1/1969 | Cox | 273/54 B X |
| 3,486,171 | 12/1969 | Zierhut | 273/54 B X |
| 4,088,318 | 5/1978 | Massman | 273/54 B |
| 4,241,922 | 12/1980 | Elliott, Jr. | 273/189 A |
| 4,618,147 | 10/1986 | Hurd et al. | 273/54 B |

OTHER PUBLICATIONS

Magazine Advertisements of Other Support Devices; namely, U-Strike by Rockford Sports Products, Inc.; Accuwrist by AccuSwing, Inc.; Pro Release by Moro Industrial Design; Cobra Wrist Support by Cobra Products of America.

*Primary Examiner*—Anton O. Oechsle

[57] ABSTRACT

A bowling support device having hand, forearm and wrist portions for maintaining the hand and wrist in the proper position during the delivery swing. A fastening strap secures the support to the wrist of the bowler while allowing upward movement of the hand at the point of release. Angular orientation of the hand and forearm portions combine with a rubber pad located at the hand portion to place the hand and wrist in a cupped position. In another embodiment, the angular orientation of the hand and forearm portions may be varied.

3 Claims, 2 Drawing Sheets

BOWLING HAND AND WRIST SUPPORT DEVICE

This is a continuation division of application Ser. No. 005,692, filed Jan. 22, 1987, Pat. No. 4,846,473.

BACKGROUND OF THE INVENTION

This invention relates in general to wrist support devices and, more particularly, to devices for supporting the hand and wrist to place them in proper position for rolling a bowling ball.

Proper positioning of the hand and wrist allows a bowler to throw an accurate and powerful ball. In one popular delivery method, the bowler's hand, wrist and forearm are maintained in alignment with the wrist remaining rigid throughout the delivery swing. Flexure or "breaking" of the wrist during the delivery backswing or downswing will cause the bowler to lose control of the ball and will reduce the accuracy of the thrown ball. In addition, if the wrist is not maintained rigid, the momentum imparted to the ball will be reduced, increasing the likelikhood that the ball will be deflected upon impact with the pins and will not carry the pins at the back of the pocket.

Available support devices have attempted to maintain the hand and wrist in the proper position for maximum accuracy and momentum but are deficient in several aspects. Most of these devices merely serve as reminders to the bowler to concentrate on keeping the wrist cupped and rigid throughout the delivery, but lack sufficient rigidity to maintain the proper positioning. Other devices are constructed of various metals or other materials which tend to lose their rigidity and usefulness over a period of time. Such devices are often constructed in a manner requiring the use of multiple straps and buckles for securing the device to the wrist, hand and forearm of the bowler. These straps and buckles are unwieldy and uncomfortable and a strap extending across the bowler's hand prevents a proper feel of the ball. Palm straps also reduce the momentum imparted to the ball by greatly restricting the upward movement of the hand at the point of release.

SUMMARY OF THE INVENTION

It is an object of the present invention to provide a bowling hand and wrist support device which will maintain the hand and wrist in a cupped position to allow the ball to be thrown with greater power.

As a corollary to the preceding object, it is another object of this invention to provide a device which is rigid and which will maintain its rigidity even after a prolonged period of usage.

It is a further object of this invention to provide a bowling support device which will restrict the lateral and downward flexure of the wrist so that greater control of the ball may be attained.

A still further object of this invention is to provide a bowling support device which, while restricting the lateral and downward flexure of the wrist, allows the hand to move upwardly at the point of release to increase the lift and power imparted to the ball.

It is another object of this invention to provide a bowling support device which is adjustable to enable the hand and wrist to be placed in variable cupped positions.

To accomplish these and other objects, the hand and wrist support device comprises a rigid shell which is molded to maintain the hand and wrist of the bowler in the proper position during the delivery swing. The shell wraps around portions of the forearm, hand and wrist of the bowler and is fastened by a releasable strap to the wrist of the bowler. The shell restricts the downward and lateral flexure of the wrist but allows the hand to move in an upward direction as the ball is being released. In an alternate embodiment of the invention, the hand and forearm portions may be adjusted to allow the hand and wrist to be placed in variable cupped positions.

BRIEF DESCRIPTION OF THE DRAWINGS

In the accompanying drawings which form a part of the specification and are to be read in conjunction therewith, and in which like reference numerals are employed to indicate like parts in the various views.

DESCRIPTION OF THE PREFERRED EMBODIMENT

Figure 1:
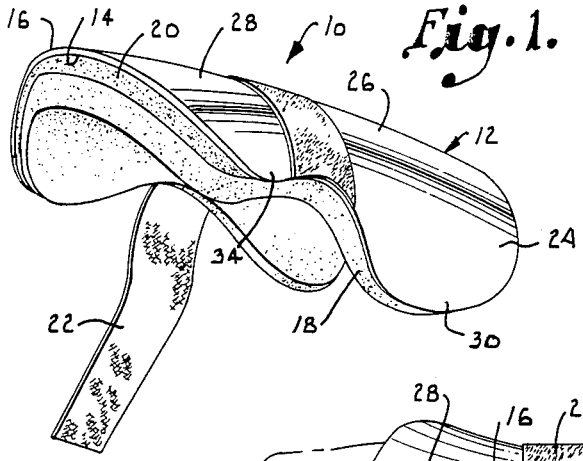
FIG. 1 is a perspective view of the hand and wrist support device of the present invention showing the fastening strap in a released position.
Figure 2:
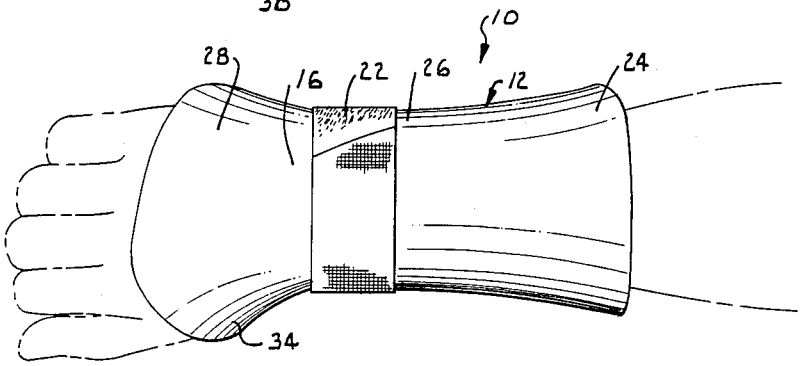
FIG. 2 is a top plan view of the device secured to the arm, shown in phantom lines, of a bowler.

Referring now to the drawings in general and FIGS. 1–4 in particular, the hand and wrist supporting device of the present invention is designated generally by the numeral 10. The device 10 comprises a rigid shell 12 having inner and outer surfaces 14 and 16, respectively, and a foam cushion 18 and a rubber pad 20 coupled with the inner surface 14. A single fastening strap 22 is coupled with outer surface 16 of the shell 12.

Figure 3:
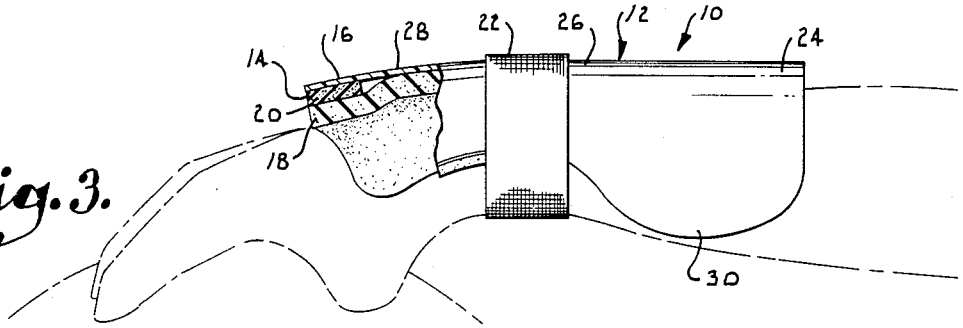
FIG. 3 is a side elevational view of the device, with portions broken away for illustration purposes, and with portions of the arm and a bowling ball represented by phantom lines.
Figure 4:
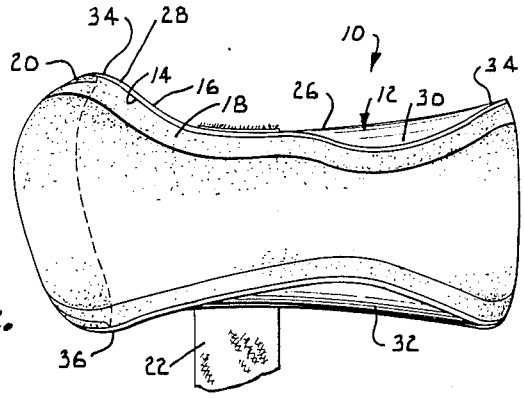
FIG. 4 is a bottom plan view of the device with the position of a padding represented by broken lines.

The shell 12 may be formed from a ⅛ inch thick mirror glazed acrylic sheet which has been cut to a specific shape, but other materials with suitable properties may be utilized. The sheet is then heat softened and molded prior to cooling to conform to the shape of portions of a bowler's hand, wrist and forearm. The formed shell 12 is of a length to extend from the knuckle area of the bowler's hand to the midforearm area. As best shown in FIG. 3, the shell comprises a forearm portion 24, a wrist portion 26, and a hand portion 28. During molding, a gradually curving bend is imparted to the shell 12 transverse to the length of the shell, such that the hand portion 28 and forearm portion 24 are slightly angularly offset with the shell 12 having a downwardly concave shape as viewed in FIG. 3. The edges of the portions 24, 26 and 28 are of a gradually curving design to eliminate any shape corners which might result in discomfort for the wearer.

The forearm portion 24 is curved so that it may wrap around portions of the bowler's forearm. The portion 24 preferably is of sufficient size to encircle approximately two thirds of the circumference of the forearm. Located at opposed sides of the portion 24 are arcuate gripping portions 30 and 32 which serve to grip the bowler's forearm to maintain the device 10 in place. The distance across the opening between the portions 30 and 32 should approximate the diameter of the forearm, but may be slightly less than the forearm diameter due to the slight flexibility of the device when a stretching force is applied across the opening.

The wrist portion 26 is likewise curved to mold to the bowler's wrist but preferably is of a size to cover about one half of the circumference of the bowler's wrist. The sides of the portion 26 are outwardly concave.

The hand portion 28 is also of a curved design and is sized to cover about one half of the circumference of the hand. Side portions 34 and 36 wrap around portions of the sides of the bowler's hand and serve to restrict lateral movement of the hand and flexure of the wrist.

The rubber pad 20 is preferably a closed cell rubber pad of a thickness greater than the shell 12 and is coupled with the inner surface 14 of the shell 12 at the hand portion 28 to protect the knuckle area of the bowler's hand. The rigidity of the shell 12 and the downward force on the hand resulting from the weight of the bowling ball might otherwise result in discomfort for the bowler. The foam cushion 18 is slightly thicker than the pad 20 and covers the inner surface 14 and overlaps the pad 20. The cushion 18 is comformable to the surface of the hand, wrist and forearm to insure a tight and secure fit of the device 10 while providing a soft material to protect the bowler from the rigidity of the shell 12. The cushion 18 is preferably an open cell urethane foam to allow air to circulate between the shell 12 and the bowler's skin for removal of perspiration.

The fastening strap 22 is glued or secured by other suitable means to the outer surface 16 of the shell 12. The strap 22 is positioned at the wrist portion 26 so that it may wrap around the wrist of the bowler without interfering with the upward movement of the hand. The strap 22 preferably comprises hook and loop (VELCRO brand) material for comfort and ease of fastening and is of a sufficient width to reduce any localized pressure on the wrist.

In use, the device 10 is positioned on the hand, wrist and forearm of the bowler and fastened securely by wrapping the strap 22 around the wrist of the bowler. A snug fit of the device is insured by the presence of the cushion 18 and the curved design of the portions 24, 26, and 28 which molds the device to the shape of the hand, wrist and forearm. The portions 30 and 32 also serve to maintain the device 10 in place by securely gripping portions of the forearm. The device 10 places the hand and wrist in a slight upwardly bent or cupped position when in a palm up position due to the angular orientation of the hand and forearm portions 28 and 24. The cupping is also accentuated by the presence of the pad 20 located at the hand portion 28, further increasing the power resulting from the delivery swing. The absence of a palm strap also allows the substantially unrestricted upward movement of the hand as the ball is being released and greatly increases the momentum imparted to the ball.

When the device 10 is in place and the strap 22 securely fastened, the side portions 34 and 36 combine with the gripping portions 30 and 32 to restrict the side to side or lateral flexure of the wrist. The rigidity of the shell 12 also prevents the downward flexure of the wrist during the delivery swing. By maintaining the hand and wrist in the proper position and eliminating or restricting downward and lateral flexure of the wrist, the device 10 greatly contributes to the accuracy and momentum of the thrown ball.

The utility of the device 10 is demonstrated by the following table in which the range of movement of the right hand with the device properly applied is contrasted with the range of movement of the right hand without the device 10.

TABLE 1

| | Without Device | With Device |
|---|---|---|
| Maximum allowable upward movement of hand | 62° | 62° |
| Maximum allowable movement to the right | 11° | 9° |
| Maximum allowable movement to the left | 61° | 5° |
| Maximum allowable movement down | 45° | 1° up |

The hand and wrist movement was measured in degrees from a horizontal or vertical reference plane extending along the forearm. The forearm was positioned on a table with the hand in a palm up position.

Figure 5:
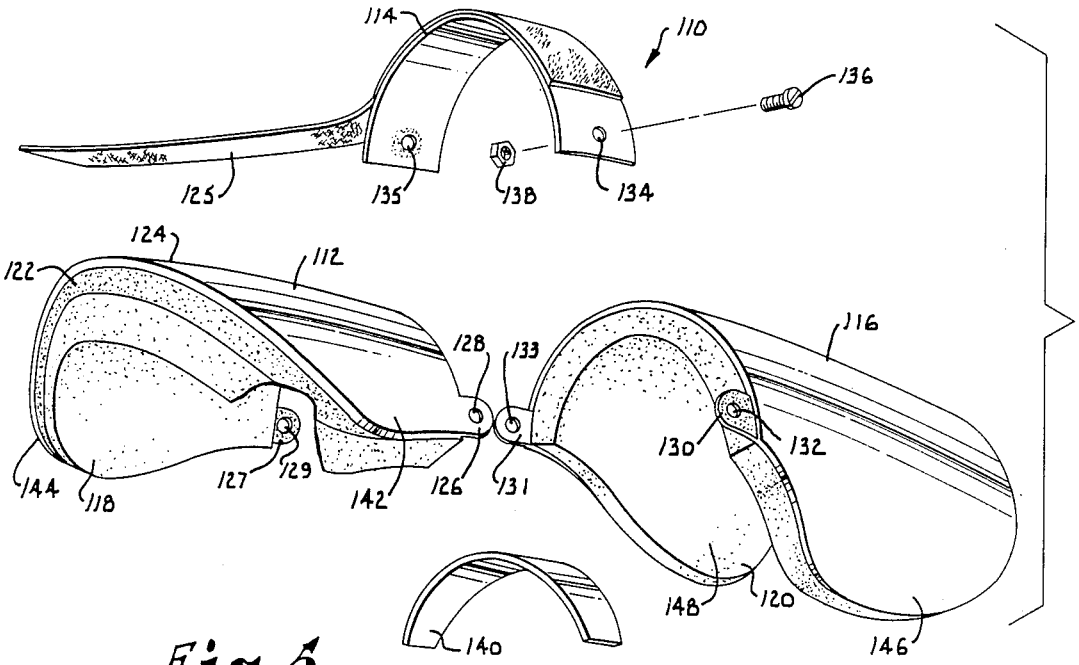
FIG. 5 is an exploded perspective view of an alternate embodiment of the device, with portions broken away to show details of construction.
Figure 6:
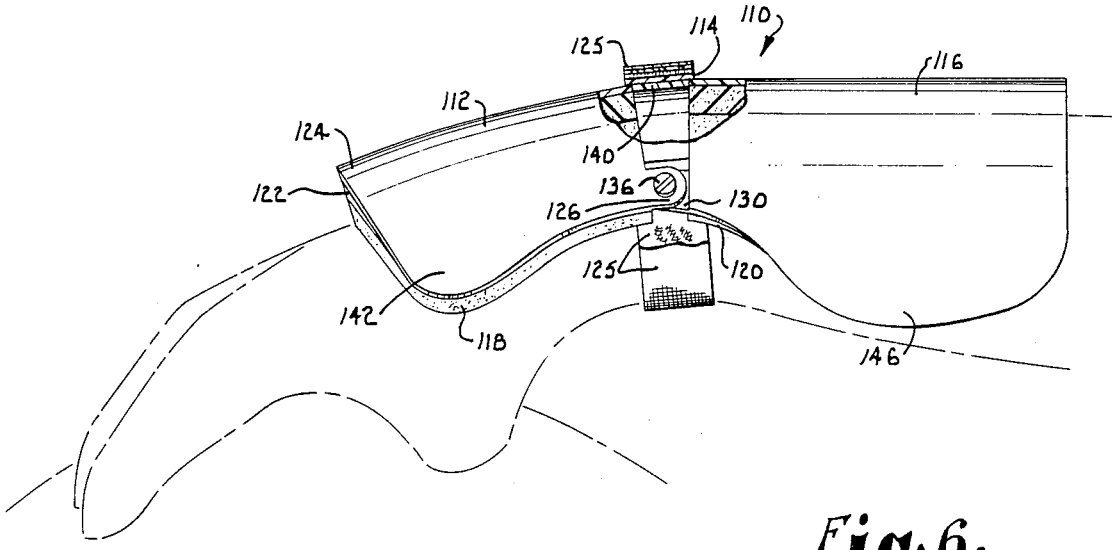
FIG. 6 is a side elevational view of the embodiment shown in FIG. 5 with portions broken away for purposes of illustration and with portions of an arm and bowling ball shown in phantom lines.

Referring now to FIGS. 5 and 6, another embodiment of the invention is represented by the numeral 110. The device 110 is similar to the device 10 previously described and comprises separate hand, wrist and forearm portions 112, 114 and 116, respectively. The portions 112, 114 and 116 are formed from ⅛ inch mirror glazed acrylic or other suitable materials in the manner previously described. Foam cushions 118 and 120 line the inner surface of the hand and forearm portions 112 and 116, respectively. A rubber pad 122 is positioned between the foam cushion 118 and the inner surface of the hand portion 112 along a forward edge 124 of the hand portion 112. A single Velcro-type fastening strap 125 similar to the strap 22 previously described is coupled with the wrist portion 114.

The hand portion 112 has a pair of projecting ears 126 and 127, each having a central hole 128 and 129, respectively. Forearm portion 116 also has a pair of projecting ears 130 and 131 having central holes 132 and 133. The wrist portion 114 also has a pair of holes 134 and 135. The portions 112, 114 and 116 are joined together to form the device 110 by positioning the portions so that the holes 128 and 132 in ears 126 and 130 are aligned with the hole 134 in the wrist portion 114. Similarly, the holes 129 and 133 of ears 127 and 131 are aligned with hole 135 in the wrist portion 114. A screw 136 is then inserted through the aligned holes and coupled with a nut 138 to secure the three portions together. A spacer 140 having the same general curvature as the hand and forearm portions 112 and 116 may be inserted beneath the wrist portion 114 to fill the gap between the hand and forearm portions which is formed when the portions are coupled together.

The hand portion 112 is similar to the hand portion 28 previously described and includes opposed side portions 142 and 144 which wrap around portions of the sides of the bowler's hand and serve to restrict lateral movement of the hand and flexure of the wrist. The pad 122 serves the same function as pad 20 by protecting the knuckle area of the bowler's hand and increasing the cupping provided by the device 110. The forearm portion 116 is also similar to forearm portion 24 and includes arcuate gripping portions 146 and 148 which serve to grip the bowler's forearm to maintain the device 110 in place.

When the device 110 is to be utilized, the bowler may loosen the screws 136 to adjust the angular relationship of the hand portion 112 to the forearm portion 116. This adjustment allows the bowler to increase or decrease the cupping provided by the device 110 to suit the bowler's individual requirements. A bowler in need of a more powerful delivery may adjust either or both of the portions 112 and 114 to increase the curvature of the device and the cupping provided by the device when applied. A bowler needing a less powerful swing may decrease the curvature of the device. When the appropriate adjustment is attained, an appropriately sized spacer 140 is inserted to fill the gap between the hand and forearm portions 112 and 116. The screws 136 are then tightened and combine with the spacer 140 to maintain the set position. Frictional surfaces may also be provided on the contact surfaces between the ears 126, 127, 130 and 131 and the wrist portion 114 to prevent movement of the portions 112, 114 and 116 once the screws are tightened.

The device 110, when strapped on the bowler's wrist, improves the accuracy of the thrown ball by reducing the lateral and downward flexure of the hand and wrist. The absence of a restrictive palm strap also allows the bowler to obtain a better feel for the ball and allows the hand to flex upward at the point of release to increase the power behind the thrown ball. The adjustability of the device 110 also allows each bowler to compensate for individual deficiencies in the delivery swing.

From the foregoing it will be seen that this invention is one well adapted to attain all of the ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A device for maintaining a bowler's hand, wrist and forearm in alignment, said device comprising:

a shell molded for application to the hand, wrist and forearm with inner and outer surfaces and having forearm, wrist and hand portions, said wrist portion being located intermediate the hand and forearm portions, said shell being rigid to restrict the downward flexure of the wrist when the bowler's hand is in the palm up position, said hand and forearm portions being angularly offset for placing the hand and wrist in a cupped position;

a pad coupled with the inner surface of the hand portion to cushion the hand and to increase the cupping of the hand and wrist;

yieldable means coupled with the inner surface of the shell to conform to the hand, wrist and forearm; and fastening for securing the device about the wrist to allow substantially unrestricted movement of the hand in an upward direction when in a palm up position.

2. A hand and wrist device adapted for application to the forearm, wrist and hand of a bowler, said device comprising:

a rigid shell molded to conform to parts of the forearm, wrist and hand and having inner and outer surfaces, and forearm, hand and wrist portions, said wrist portion being located intermediate said hand and forearm portion, said hand and forearm portions being angularly offset for placing the hand and wrist in a cupped position;

said hand portion including at least one side portion for restricting said flexure of the wrist and a cushion coupled with the inner surface of the shell for conforming to the hand, wrist and forearm to insure a tight fit of a device, and a rubber pad coupled with the inner surface at the hand portion to cushion the hand and to increase the cupping of the hand and wrist; and a fastening strap coupled with the outer surface at the wrist portion for securing the device to the wrist, whereby the device when applied to the forearm, wrist and hand allows substantially unrestricted upward movement of the hand when in a palm up position while restricting downward and lateral flexure of the wrist.

3. A device for maintaining a bowler's hand, wrist and forearm in the desired alignment, said device comprising:

a one-piece, generally rigid shell having hand, wrist and forearm portions molded for application to the bowler's hand, wrist and forearm, said portions being adapted for preventing downward flexure of the wrist when the hand is in a palm up position, said hand and forearm portions being angularly offset for placing the hand and wrist in a cupped position when applied thereto;

said hand portion having opposed side portions for wrapping around portiond of the sides of the hand to restrict lateral flexure of the wrist;

yieldable means coupled with the inner surface of the hand and the forearm portions to conform to the bowler's hand and forearm, said forearm portion including opposed gripping portions for wrapping around portions of the side of the forearm to maintain the device in place and wherein a pad is coupled with the inner surface of the hand portion to cushion the hand and to increase the cupping of the hand and wrist; and fastening means for securing the device about the bowler's wrist while allowing substantially unrestricted upward movement of the hand when in the palm up position.

* * * * *